United States Patent [19]

Tolliver et al.

[11] Patent Number: 4,583,744

[45] Date of Patent: Apr. 22, 1986

[54] PROJECTILE CAPTURING DEVICE AND TARGET

[75] Inventors: Wilbur E. Tolliver, Holland; Larry R. Magnuson, Muskegon, both of Mich.

[73] Assignee: Tolcon Steel Corporation, Grand Rapids, Mich.

[21] Appl. No.: 594,021

[22] Filed: Mar. 27, 1984

[51] Int. Cl.[4] ..... F41J 1/10; F41J 1/14; F41J 1/16

[52] U.S. Cl. ..... 273/404; 273/378; 273/396; 273/406; 273/407

[58] Field of Search ..... 273/404, 410, 406, 407, 273/408, 378, 396; 40/514–517, 471, 116; 282/3 A, 5, 11.5 A, 11.5 R

[56] References Cited

U.S. PATENT DOCUMENTS

| | | | |
|---|---|---|---|
| 398,186 | 2/1889 | Rehfuss | 273/404 |
| 587,567 | 8/1892 | Breakspear et al. | 282/5 |
| 626,532 | 6/1899 | Faure | 40/471 |
| 691,643 | 1/1902 | Loss et al. | 273/396 X |
| 883,077 | 3/1908 | Baker | 273/404 |
| 937,733 | 10/1909 | Worrell | 273/404 |
| 1,379,411 | 5/1921 | Manny | 282/3 A |
| 1,681,168 | 8/1928 | Bovier | 282/11.5 A |
| 1,770,080 | 7/1930 | Lewis | 282/3 A |
| 1,981,293 | 11/1934 | Varrelman | 273/406 X |
| 2,048,155 | 7/1936 | Armantrout | 273/407 |
| 2,228,419 | 1/1941 | Stern | 282/11.5 R UX |
| 3,197,207 | 7/1965 | Sanzare | 273/410 |
| 3,203,698 | 8/1965 | Saunders | 273/404 |
| 3,319,960 | 5/1967 | Wilcox | 273/404 |
| 3,404,887 | 10/1968 | Dundr | 273/410 |
| 3,495,829 | 2/1970 | Booth | 273/404 X |
| 3,519,272 | 7/1970 | De Vogelaere | 273/406 X |
| 3,587,183 | 6/1971 | Davis | 40/515 |
| 3,899,175 | 8/1975 | Loe | 273/378 |
| 3,982,761 | 9/1976 | De Vogelaere | 273/410 |
| 4,026,053 | 5/1977 | Canon | 40/471 |
| 4,247,116 | 1/1981 | McQuary | 273/404 X |

FOREIGN PATENT DOCUMENTS

| | | | |
|---|---|---|---|
| 197892 | 3/1938 | Switzerland | 273/407 |

OTHER PUBLICATIONS

Popular Mechanics 6–1974, p. 141.
B. Zeitz & Sons' brochure.
Peterson's Instant Targets' brochure, p. 6.
Linatex Corporation of America brochure.
Detroit–Armor Corp. brochure.
Omarks Industries' brochure, p. 9.
Marksman brochure.
Sure Stop Mfg., Inc. brochure.
Stanley Hips Targets' brochure.

*Primary Examiner*—Paul E. Shapiro
*Attorney, Agent, or Firm*—Price, Heneveld, Huizenga & Cooper

[57] ABSTRACT

A target assembly that includes a housing in which are mounted a plurality of interceptors made of flexible, energy absorbing material that hang down behind a target face mounted thereon. Preferably, three such interceptors hang from a downwardly, rearwardly sloping rear wall of the housing. A continuous roll of adjacent target faces is mounted in the lower portion of the housing, each successive target face being hooked to the top of the housing for use. The target faces are made of a polymeric material having a color contrasting to the color of the interceptors.

26 Claims, 6 Drawing Figures

PROJECTILE CAPTURING DEVICE AND TARGET

BACKGROUND OF THE INVENTION

The present invention relates to projectile capturing devices and targets, and especially for use with target ammunition such as plastic bullets, BB's, pellets and the like.

A wide variety of assemblies have been heretofore used in order to support conventional target faces. A feature common to such conventional target assemblies is a mounting surface or frame on which a target face is attached. Normally, a backstop is either positioned behind the target supporting frame or is used to actually support the target face. This backstop is used to stop the flight of projectiles fired at the target and thereby attempting to prevent ricochets which may result in injury or damage to surrounding persons or objects.

Most conventional bullet traps fall into two classes. One class includes bullet traps that have a backdrop in which the projectile is embedded or through which the projectile passes in order to absorb the projectile's energy. A second class of bullet traps make use of a backstop or rear barrier that deflects or otherwise traps the projectile in a confined area after the projectile has passed through the target face. Bullet traps of both such classes are adequate when used with projectiles that are to be fired a single time and are not intended to be reusable. However, common problems are experienced with both of these types of bullet traps when the trap is used with reusable projectiles. In traps having a backdrop in which the projectile is embedded, recovery of the projectile is extremely difficult. If the backdrop is made from a rigid material, the projectile must be pried out of the material. Not only does removing the projectile consume time, but quite often the projectile is deformed. If loose cushioning material is used to stop the projectile, not only is the backstop bulky but this cushioning material must be searched through in order to recover the projectile, which is also a time consuming procedure. In bullet traps that either deflect or trap the projectile, when the projectile strikes the trap the projectile is often damaged. Reusable projectiles, such as plastic or the like, when damaged do not provide the proper aerodynamic properties necessary for true flight.

A second common problem is experienced with most conventional bullet traps. Normally an individual target face is secured to the mounting frame before each use. After the target face has been used, the target face is removed and replaced with a new target face. This requires that a stack of target faces be stored and separately carried by the user, in addition to each requiring individual mounting on the frame.

Heretofore, most such target faces have been made from either paper or cardboard material, or in the case of some target faces used for archery foam or burlap material. When shotting low velocity, blunt nose projectiles, the problem experienced with such target faces is that as the projectile passes through the target face, the projectile tears the target face rather than leaving a well defined hole. Due to the ragged puncture or tear left by the projectile, it is difficult from a distance to ascertain the exact location that the projectile struck the target face.

SUMMARY OF THE INVENTION

The present invention solves the problems noted above by the provision of a capturing device with interceptors that absorbs the energy from a fired projectile without substantial damage to the projectile itself. In one aspect of the present invention, a projectile capturing device is provided including a target housing with a depending interceptor of flexible, energy absorbing material that hangs down freely behind the target face. The flexible interceptor is spaced in front of the housing backwall so that the interceptor may flex freely when struck by a projectile. Preferably, a plurality of flexible interceptors hang downward from a rearwardly, downwardly sloping housing backwall in order to form a backdrop for the entire target face.

In another aspect of the invention, a target face is provided that is formed from a polymeric material. Suprisingly, although a low velocity projectile traveling at a velocity less than 600 FPS passes freely through the target face, the projectile leaves a clearly defined aperture without leaving obsecuring tears in the target face.

In still another aspect of the invention, a plurality of target faces are stored in one continuous strip on a roll. The roll is mounted in the projectile capturing housing so that while one individual target face is being used, the remainder of the target faces remain compactly stored on the roll. Each target face is separated from successive target faces by perforations that provide for the easy removal of a used target face from the roll.

DETAILED DESCRIPTION OF THE PREFERRED EMBODIMENT

Figure 2:
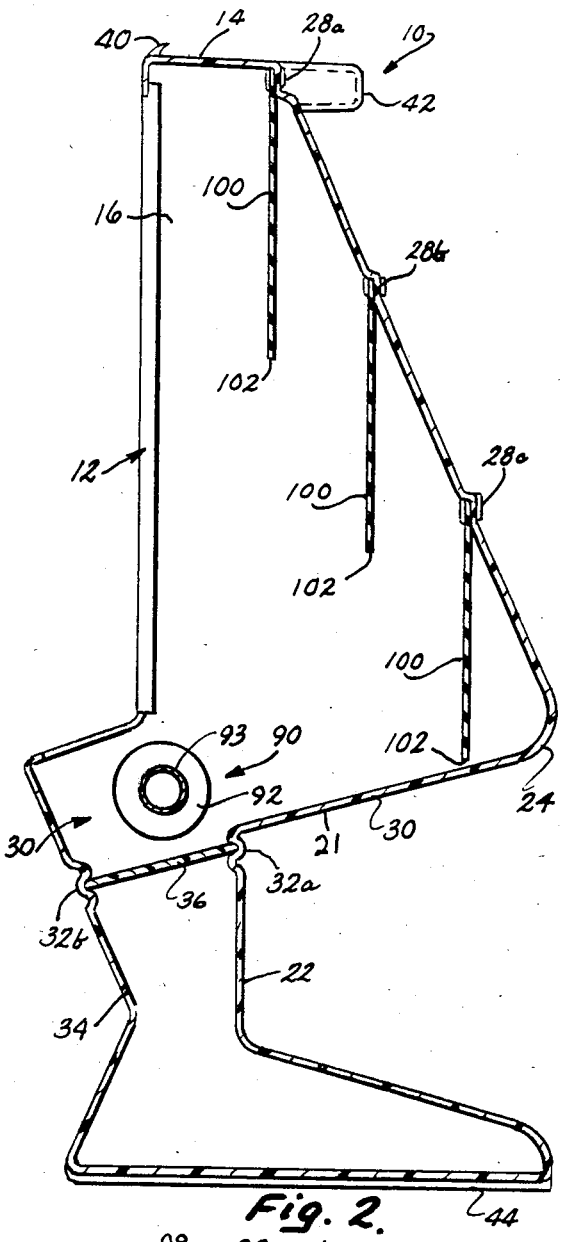
FIG. 2 is a side sectional view taken along plane II—II of FIG. 1.
Figure 1:
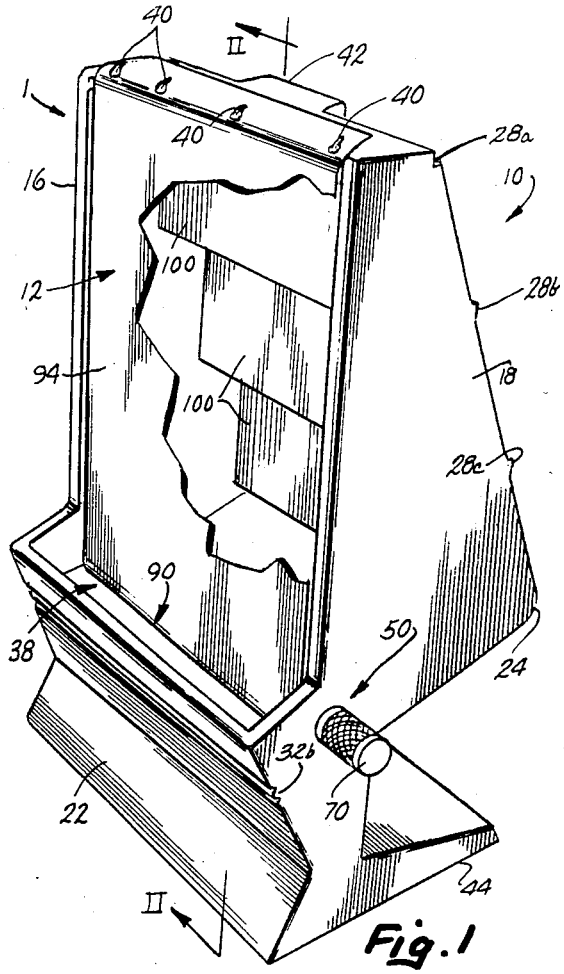
FIG. 1 is a front perspective view of a projectile capturing device assembly embodying the present invention with a portion of the target face broken away.

In the preferred embodiment, capturing device assembly 1 includes a housing 10 with an open front that defines a target face mounting zone 12, FIGS. 1 and 2. A roller mounting assembly 50 is located in housing 10 at the lower end of target face mounting zone 12. Roller mounting assembly 50 is used to mount a continuous roll 90 of target faces 94 onto housing 10, FIGS. 5 and 6. An individual target face 94 is stretched across target face mounting zone 12 and secured to the upper portion of housing 10. Secured to housing 10 are a plurality of flexible, high impact resistant interceptors 100 which are mounted to hang freely behind target face mounting zone 12. The lower ends of interceptors 100 are unsecured so that as a projectile is fired into housing 10, the projectile strikes interceptor 100, which in turn moves freely to absorb the energy of the projectile allowing it to drop downward into housing 10 without damaging the projectile or being pierced thereby. The projectiles are deposited into a projectile collecting trough 38 that is located in front of target mounting zone 12 and roller mounting assembly 50. The used projectiles are therefore accessible in trough 38 without reaching back into housing 10 or behind the target face mounted in target mounting zone 12.

Figure 3:
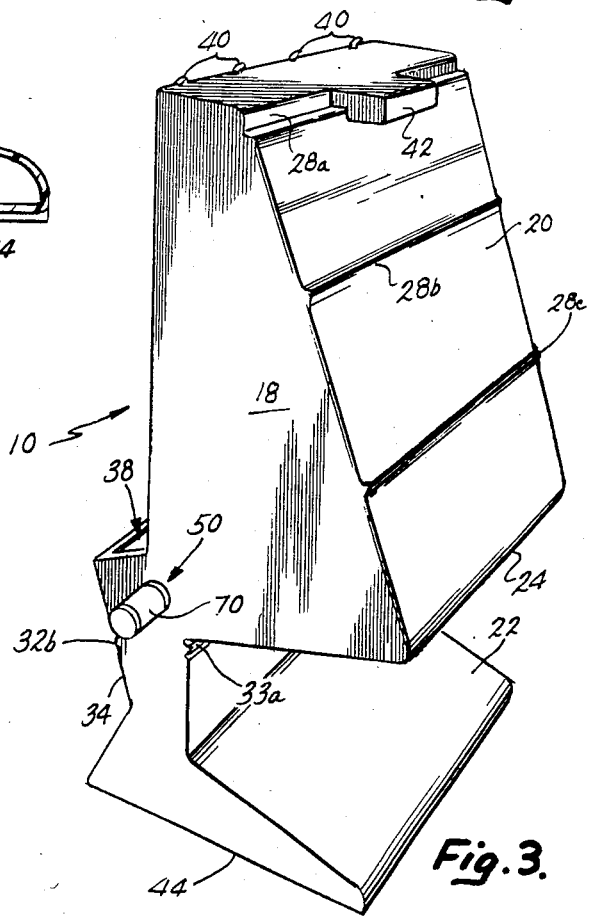
FIG. 3 is a rear perspective view of the assembly shown in FIG. 1.

As shown in FIGS. 1 through 3, housing 10 is made from a high impact resistant polymeric material and includes a top wall 14, sidewalls 16 and 18, a sloping rear wall 20, a floor 21 and a base 22. Rear wall 20 slopes downward rearwardly from top wall 14 to a lower bend 24. Lower bend 24 is located behind the lower portion of target mounting zone 12 and joins rear wall 20 with floor 21. Sloping rear wall 20 includes three narrow, indentations or bands that form vertically oriented interceptor mounting surfaces 28. Interceptor mounting surfaces 28 are formed integrally with rear wall 20 in a step-like fashion. A first interceptor mounting surface 28*a* is located immediately adjacent top wall 14 and is formed by a slight indentation at the intersection between top wall 14 and rear wall 20. Spaced subsequently downward from interceptor mounting surface 28*a* are two lower interceptor mounting surfaces 28*b* and 28*c*, respectively. Interceptor mounting surfaces 28*b* and 28*c* are smoothly formed projections on rear wall 20 that divide rear wall 20 into three roughly equal sections. Due to the downward, rearward slope of rear wall 20, interceptor mounting surface 28*a* is spaced forward of or nearer to target face mounting zone 12 than interceptor mounting surface 28*b*. Similarly, interceptor mounting surface 28*b* is spaced forward of interceptor mounting surface 28*c*. Interceptor mounting surfaces 28 are used to mount interceptors 100 as described hereinafter.

Floor 21 extends forward downwardly from housing lower bend 24. Floor 21 extends beneath interceptor mounting surfaces 28 and interceptors 100 mounted thereon. Floor 21 terminates slightly to the rear of target face mounting zone 12 and joins with base 22 thereat. Located on base 22 just beneath the intersection with floor 21 is an insert mounting channel 32*a*. Channel 32*a* is formed by a pair of spaced indentations on the upper edge of base 22. Base 22 includes a non-vertically angled front wall 34 on which a second insert mounting channel 32*b* is formed by a similar pair of spaced indentations. Channel 32*b* is spaced slightly lower than rear insert channel 32*a*. Both insert channels 32*a* and 32*b* extend laterally the entire width of housing 10. As shown in FIG. 2, a planar, rectangular insert 36 is snapped between channels 32 in order to form an extension of floor 21. Due to the vertical displacement of channels 32, insert 36 is also forwardly, downwardly sloping. Any projectile rolling down floor 21 will continue to roll down insert 36, underneath roller mounting assembly 50 to the front of target housing 10. Front wall 34 extends upward past insert 36 in order to form a projectile collecting trough or tray 38 located in front of target face mounting zone 12 and target roll 90 and target mounting assembly 50. Front wall 34 extends upward forward of roller mounting assembly 50 so that trough 38 is also located forward of roller mounting assembly 50. This permits the user to simply reach into trough 38 at the front of housing 10 for the used projectiles, rather than reaching back into housing 10 and behind target mounting zone 12. As shown in FIG. 2, front wall 34 angles upward first rearwardly and then forwardly so that stray projectiles that may strike wall 34 will not be bounced directly forward.

Spaced along the front, upper edge of top wall 14 are four upwardly, rearwardly extending hooks 40, FIGS. 1-3. Hooks 40 form small, curved projections integral with top wall 14, each of which includes a rearwardly facing pointed end. Hooks 40 are used in the mounting of a target face 94 on housing 10 as hereinafter explained.

Extending rearward from the top of rear wall 20 is a carrying handle 42. Handle 42 extends rearward over the center of gravity of housing 10. Base 22 includes a rearwardly extending platform or foot 44 that extends rearward of the center of gravity of housing 10. Platform 44 extends rearward sufficiently far that projectiles that strike interceptors 100 are unable to knock over housing 10.

Housing 10 is preferably rotationally molded from polyethylene material of sufficient thickness to withstand accidental impacts by a misfired plastic bullet, pellet or BB. Exemplary of a preferred material is a resin sold by the Soltex Polymer Corporation of Houston, Tex. under the designation XF419. This material has a tensil strength of 2800 psi, a percentage of elongation of 65%, a flexural modulus of 85,000 psi, a stiffness of 47,000 psi and a density of 0.935 grams per cubic centimeter. This material is sufficiently impact resistant to absorb the impact of inadvertently fired projectiles without cracking or penetrating housing 10.

After housing 10 is rotationally molded, the opening at target mounting zone 12 is cut away and removed, and insert 36 is cut from the removed material. Insert 36 is then simply snapped between channels 32*a* and 32*b*.

Figure 4:
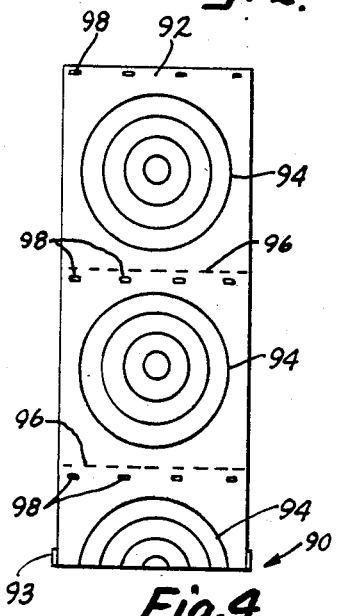
FIG. 4 is a front elevational view of a continuous roll of joined target faces embodying the present invention and used in the assembly of FIG. 1.

As shown in FIGS. 2 and 4, roll 90 to be used in housing 10 includes a continuous strip of plastic material 92 that is tightly wound on roller cylinder 93. Strip 92 is a continuous length of polymeric material which has been imprinted with a number of consecutive, adjacent target faces 94. Target faces 94 may be imprinted with any desired configuration, such as conventional concentric circles or animal configured silhouettes. Target faces are made from a light colored plastic material in order to contrast with the color of interceptors 100. Each individual target face 94 is separated from adjacent target faces by a line of perforations 96 which extend between the sides of plastic strip 92. Perforations 96 form a line along which adjacent target faces may be readily separated. At the top edge of each target face 94 immediately adjacent perforation line 96 are four apertures 98. Apertures 98 are spaced so as to correspond to the spacing of hooks 40. This permits target faces 94 to be mounted on housing 10 by punching hooks 40 through apertures 98. When roll 90 is mounted on roller mounting assembly 50 plastic strip 92 may be pulled upward until apertures 98 are fitted over hooks 40. One target face 94 will then be positioned within target face mounting zone 12 while the remaining target faces are compactly stored on roll cylinder 93 in the lower portion of housing 10.

Target strip 92 is most preferably made from a low density polyethylene material having a thickness of six mil (one mil equals one thousandths of one inch). However, polyethylene ranging between two and ten mils is acceptable. Alternatively, polypropylene or sheet vinyl may be used for strip 92.

One reason that target faces 94 are preferably formed from this material is due to the results obtained when the target faces are struck by a low velocity projectile. Although the projectile passes freely through target face 94, the projectile punches out a clearly defined hole in target face 94. A clearly defined circle of target face material is cut from target face 94 and pushed backward through strip 92. (A small portion of the circle may remain uncut, leaving a circle shaped flap hanging down behind strip 92). In contrast with paper cardboard material the projectile will frequently "tear" the target face leaving ragged aperture edges or tears that make positive scoring analysis more difficult.

A second reason that target face 94 is preferably formed from the above material is that this material allows target face 94 to stretch somewhat. This stretching allows target face 94 to be mounted tautly across target mounting zone 12 without the need for any spring or clutch mechanism in roller mounting assembly 50.

Figure 5:
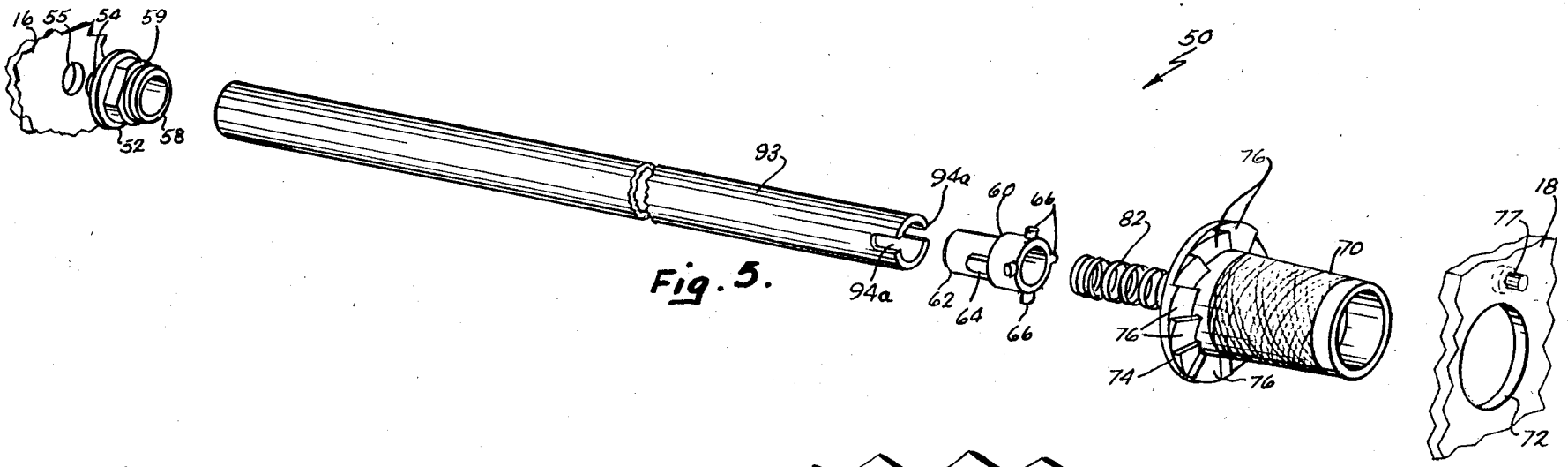
FIG. 5 is a perspective, exploded view of the target roller mounting assembly used in the assembly shown in FIG. 1.
Figure 6:
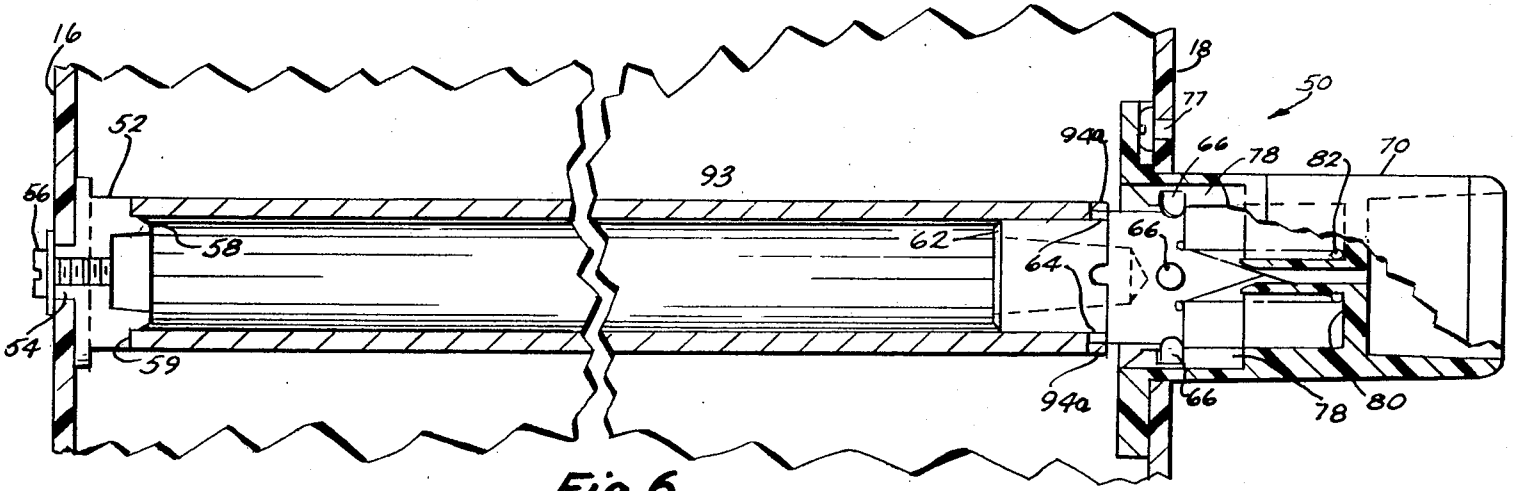
FIG. 6 is a fragmentary, front sectional view of the target roller mounting assembly shown in FIG. 5.

As shown in FIGS. 5 and 6, target roll mounting assembly 50 includes a left side roller mounting element 52, a right side roller mounting element 60, a handle 70 and a spring 82. Assembly 50 is mounted to extend target roll 90 between sidewalls 16 and 18, with roller mounting element 52 stationarily mounted on sidewall 16. Roller mounting element 52 includes a cylindrical mounting post 54 that extends through an aperture 55, FIG. 5, in sidewall 16. A bolt and washer 56, FIG. 6, secure mounting element 52 to sidewall 16. A large diameter circular flange 57 extends about one end of element 52 to form a secure abutment with sidewall 16. Extending from the the side of mounting element 52 opposite sidewall 16 is a central plug 58. Plug 58 is shaped to fit within the central opening of target roll roller cylinder 93, but which allows the rotation of roller cylinder 93 thereabout. Central plug 58 defines an annular shoulder 59 thereabout, against which roller cylinder 93 is firmly abutted. Roller cylinder 93 rotates on mounting element 52 about plug 58.

Roller mounting element 60 includes on one side a cylindrical plug 62 that extends axially toward roll cylinder 93. Plug 62 has a diameter adapted to be received in the end of roller cylinder 93 opposite mounting element 52. Located in the end of roller cylinder 93 are two aligned notches **94*a*. Notches 94*a* receive a pair of mating projections 64 located on either side of mounting element 60. Projections 64 fit snugly into notches 94*a* and are used in the turning of target roll 90 as described below. Extending radially about roller mounting element 60 opposite the end that inserts into roller cylinder 93 are four square shaped projections or pegs 66. Projections 66 are used to couple mounting element 60 to a handle 70 that is used to turn roll 90**.

Handle 70, FIGS. 5–6, is received through an aperture 72 in sidewall 18 so as to be able to rotate therein. Handle 70 includes a radially extending locking flange 74 at one end that prevents handle 70 from passing entirely through sidewall 18. Located on flange 74 facing sidewall 18 are twelve locking ramps 76. Ramps 76 are positioned so as to contact a bolt or rivet 77 that is fixed and projecting inwardly of the inner side of sidewall 18 adjacent aperture 72. Bolt 77 forms a means for stopping handle 70. Ramps 76 are oriented to form a ratchet surface that permits rotation of handle 70 in a counterclockwise direction when handle 70 is pressed against sidewall 18. When flange 74 is pressed against sidewall 18, ramps 76 prevent the rotation of handle 70 in a clockwise direction due to abutment with stop bolt 77.

As shown in FIG. 6, handle 70 includes a central cavity that extends axially through flange 74. Spaced about the inner surface of handle 70 are four rectangular keyways 78 that are shaped to receive sliding projections 66 on mounting element 60. Roller mounting element 60 is therefore allowed to slide freely laterally within handle 70, but rotates with handle 70 due to the seating of projections 66 in keyways 78. Handle 70 also includes an internal spring mounting seat 80. A spring 82 is mounted on seat 80 and is compressed between handle 70 and roller mounting element 60 when roller cylinder 93 is mounted on mounting element 60. Spring 82 therefor biases handle 70 away from mounting element 60 and forces locking flange 74 into abutment with sidewall 18 and stop bolt 77 when roller cylinder 93 is engaged with mounting element 60, as shown in FIG. 6. When a roll 90 is mounted on roller mounting assembly 50, handle 70 may be pressed inward to release ramps 76 from stop 77 and unroll one target face 94. Target face 94 is then hooked over hooks 40 and handle 70 is turned to take up any slack in strip 92. Due to the stretching qualities of strip 92, target face 94 stretches taut and resiliently rotates handle 70 back clockwise to resiliently hold wedges 76 in abutment with stop 77.

Shown in FIGS. 1 and 2, three flexible, energy absorbing interceptors 100 are mounted on interceptor mounting surfaces 28. Interceptors 100 are rectangular sheets of rubber or polymeric material which are each fastened along their upper edge to interceptor mounting surfaces 28. Interceptors 100 depend from mounting surfaces 28 and each have an unsecured lower end 102. Interceptors 100 are therefore allowed to hang freely and both flex and pivot about mounting surface 28 when struck by a projectile. Interceptors 100 each extend the entire width of housing 10. Since mounting surfaces 28 are horizontally spaced by sloping wall 20, interceptors 100 are similarly spaced with uppermost interceptor 100 nearest the front of housing 10. Interceptors 100 depend far enough downward to overlap vertically with the next adjacent interceptor thus preventing projectiles from striking the mounting surface of such next adjacent interceptor. Mounting surfaces **28*b* and 28*c* are therefore overhung by the upper adjacent interceptor 100. Interceptors 100 therefore form a backdrop behind the entirety of target mounting zone 12. Since three interceptors 100 are used to form a backdrop behind the entire target mounting zone 12 instead of a single large interceptor, the distance that each interceptor 100 hangs down is reduced. This reduces the amount of interceptor material that hangs down beneath the point of impact of any given projectile. The interceptor material that hangs beneath the point of impact of a projectile forms a moment arm that resists the free flexing of interceptor 100, so that shorter interceptors 100 have less of a tendency to bounce projectiles straight back out of housing 10. For this same reason interceptors 100 overlap vertically some distance to cover the interceptor material immediately adjacent mounting surfaces 28*b* and 28*c*. Since interceptors 100 are mounted on sloping wall 20 and are horizontally spaced thereby, interceptors are unrestricted by housing 10** to flex or pivot backward when struck by a projectile.

Interceptors 100 are preferably made from a rubber or polymeric material that is sufficiently impact resistant to withstand penetration by a conventional pellet, BB's or plastic projectile, but must be sufficiently resilient to flex upon impact. Most preferably interceptors 100 are made from a fused polyvinyl material that has the following composition in percentages by weight: dioctyl thalate 31.4%; vinyl resin 63.2%, epoxidized soybean oil 3.0%; heat stabalizer 1.2%; black dispersion 1.2%. This material has a density of seventy-two pounds per cubic foot. Preferably interceptors 100 are made from sheets of the above material having a thickness falling in the range of 0.155 to 0.17 inches. Alternatively, other materials having the above resiliency and impact resistant properties may be used, for example a urethane material.

Interceptors 100 are most preferably black in color. This permits ready identification of the hole left by the projectile in contrastingly colored target face 94. Although black is most preferred, other dark contrasting colors may be used.

ASSEMBLY AND OPERATION

In order to use the target, roll 90 is mounted on roller mounting assembly 50. Roller cylinder 93 is first inserted over plug 62 on mounting element 60 so that projections 64 are received in notches 94*a*. Roller cylinder 93 is then forced against mounting element 60 so that spring 82 is compressed and mounting element 60 slides into handle 70 toward sidewall 18. Roller cylinder 93 may than be snapped down over extending plug 58 on roller mounting element 52. When roller cylinder 93 is released, spring 82 will force roller mounting element 60 away from sidewall 18 and thus trap roller cylinder 93 between mounting elements 52 and 60. In order to advance a single target face 94 off of roll 90, handle 70 is first depressed inward in order to release ramps 76 from stop 77. Once ramps 76 have cleared stop 77, handle 70 may be turned clockwise in order to feed a target face 94 off of roll 90.

The unrolled target face 94 of plastic strip 92 is stretched upward across target face mounting zone 12 and hooks 40 are punched through apertures 98. Handle 70 is thereafter rotated counterclockwise in order to take up any slack in target face 94. The polymeric material of target face 94 is stretched taut and locking ramps 76 contact stop 77 to prevent any further slack from unrolling. After the target face is used, the next subsequent target face may be unrolled, the new target face hooked over hooks 40, and the used target face simply torn off along perforated line 96.

When a person fires at the target, the projectiles pass through target face 94 and enter housing 10. Since interceptors 100 overlap, interceptors 100 form a backdrop behind the entirety of target face 94. The projectile will therefore necessarily strike one of the interceptors 100. When struck by the projectile, interceptor 100 flexes and swings freely in order to absorb the energy of the projectile. Since rear wall 20 slopes rearwardly, the remaining interceptors 100 and sidewalls 16 and 18 are held out of contact with the interceptor that is struck. The projectile thereafter drops downward within housing 10 rather than being bounced back outward toward the user. The spent projectiles fall onto floor 21 and rolls forward down into collecting trough 38. The person thereafter simply reaches into collecting trough 38 for retrieval of the used projectiles.

Since front wall 34 of base 22 is not a vertical wall but rather is angled along its entire surface, any stray projectile which may strike front wall 34 will not be deflected straight back toward the user. Further, since front wall 34 projects upward in front of roller mounting assembly 50, front wall 34 protects roller mounting assembly 50 from being struck by stray projectiles.

It has been found that target faces 94 made from the above described materials are pierced cleanly by projectiles. The projectiles leave a clearly defined aperture in the plastic material, on occasion the removed flap of material remaining affixed to the back of the target face, rather than leaving a ragged edge or tears which extend outward into the face as occurs with other target faces. Due to the light color of target faces 94 and the dark contrasting color of interceptors 100, this clearly defined aperture is readily visible from a distance away from the target. This permits the instant location of the point of impact by the user and a subsequent correction in his aim.

It is to be understood that the above is merely a description of the preferred embodiment and that various modifications could be made by one skilled in the art without departing from the concept of the invention disclosed therein. The scope of protection to be afforded is to be determined by the claims which follow and the breadth of interpretation which the law allows.

The embodiments of the invention in which an exclusive property or privilege is claimed are as follows:

1. A projectile capturing device comprising:

a housing defining a target mounting zone and having a rear support surface including a rearwardly, downwardly sloping rear wall;

means for mounting a pierceable target face on said housing in said target mounting zone at a location in front of said rear support surface;

a plurality of flexible, impact resistant interceptor elements all of substantially the same length mounted on said rear wall to be generally spaced therefrom, each said interceptor element having an upper end mounted on said rear wall to depend freely therefrom behind said target mounting zone and having an unsecured lower end, said flexible interceptor elements being adjacently, vertically arrayed in an overlapping relationship relative to each other in that the upper end of a lower one of said interceptor elements is located at a height at least as high as said lower end of the next adjacent said interceptor element, so that said interceptor elements form a backdrop behind substantially the entirety of said target mounting zone, said flexible interceptor elements being each horizontally spaced from the others of said flexible interceptor elements, whereby when a projectile passes through a target face mounted on said housing and strikes said interceptor element, said interceptor element flexes and moves freely to deflect the projectile downward without substantially deforming the projectile or piercing said interceptor element;

said housing including a forwardly, downwardly sloping floor located under said target mounting zone and said flexible interceptor elements, said housing including a stopwall extending upwardly from the front of said floor such that said stopwall and said floor comprise a collecting trough disposed in front of said target mounting zone whereby projectiles collected in said trough are accessible in front of said target mounting zone;

a roller mounting assembly disposed at a first side of said target mounting zone, said roller mounting assembly including means for mounting a roll of target faces on said housing;

means for securing a target face to said housing at an opposite second side of said target mounting zone from said first side;

said roller mounting assembly including a turning handle rotatably mounted in said housing;

a stop projecting from one of said housing and said handle, the other of said housing and said handle including stop surfaces thereon disposed to selectively contact said stop; and means for selectively shifting said stop surfaces out of contact with said stop.

2. The projectile capturing device of claim 1, wherein:

said roller mounting assembly includes a first and second roll mounting element having means for supporting a roll of target faces therebetween, said first roll mounting element being mounted on said housing, and said second roll mounting element being slidably coupled to said turning handle to rotate therewith; and means for slidably biasing said turning handle away from said second roll mounting element and for biasing said stop surfaces into contact with said stop.

3. The projectile capturing device of claim 2, further comprising:

a continuous roll of target faces mounted on said roller mounting assembly.

4. The projectile capturing device of claim 3, wherein:

said securing means includes a plurality of target face receiving hooks located on said second side of said target mounting zone.

5. The projectile capturing device of claim 4, wherein:

said continuous roll of target faces includes a plurality of adjacent individual target faces, each said individual target face being separated from said adjacent target faces by a line of perforations therein.

6. The projectile capturing device of claim 5, wherein:

said target assembly includes three said flexible interceptor elements.

7. The projectile capturing device of claim 6, wherein:

said flexible interceptor elements are each made from a fused polyvinyl material.

8. A projectile capturing device comprising:

a housing having an upper surface defining a target mounting zone thereunder, and said housing having a rear support surface;

a plurality of flexible, impact resistant interceptor elements mounted on said rear support surface to be generally spaced therefrom, each said interceptor element depending freely from said rear support surface behind said target mounting zone and having an unsecured lower end, said flexible interceptor elements being adjacently, vertically arrayed in an overlapping relationship so that said interceptor elements form a backdrop behind substantially the entirety of said target mounting zone, whereby when a projectile passes through a target face mounted on said housing and strikes one of said interceptor elements, said interceptor element flexes and moves freely to deflect the projectile downward without substantially deforming the projectile or piercing said interceptor element;

a forwardly, downwardly sloping collecting surface located in said housing under said interceptor elements;

a projectile collecting trough connected to said housing forward of said target mounting zone to be communicative with said collecting surface, said collecting trough having a generally upstanding forward stopwall and a collecting trough opening to the exterior of said housing forward of said target mounting zone, whereby when a projectile is deflected downward by said interceptor element said projectile rolls down said collecting surface and is deposited into said collecting trough forward of said target mounting zone;

a roller mounting assembly on said housing disposed at a first side of target mounting zone and accessible from the exterior of said housing, said roller mounting assembly including means for mounting a roll of target faces on said housing and means for selectively preventing said roll of target faces from unrolling;

a plurality of target mounting hooks located at an opposite second side of target mounting zone from said first side on the exterior of said housing, whereby a target roll is mountable on said roller assembly and a new target face therefrom is secured in said target mounting zone by grasping the end of said roll from the exterior of said housing and by unrolling said new target face from said roll and hooking on said hooks, providing a previously used target face with the ability to be torn from said roll adjacent said hooks from the exterior of said housing said forward stopwall upstanding in front of said roller mounting assembly to define betweeen said upper surface and said forward stopwall a generally vertical projectile entrance zone that is smaller than said target mounting zone, said collecting trough opening communicating with said target mounting zone to provide therethrough an unobstructed access opening to said roller mounting assembly disposed beneath said projectile entrance zone, whereby said forward stopwall protects said roller mounting assembly, and said roller mounting assembly is accessible through said target mounting zone and said collecting trough opening to change a target face roll mounted thereon.

9. The projectile capturing device of claim 8, further comprising:

a continuous roll of target faces mounted on said roller mounting assembly.

10. A projectile capturing device comprising:

a housing defining a target mounting zone and having a rear support surface;

means for mounting a pierceable target face on said housing in said target mounting zone at a location in front of said rear support surface;

a flexible, impact resistant interceptor element mounted on said rear support surface to be generally spaced therefrom, said interceptor element depending freely from said rear support surface behind said target mounting zone and having an unsecured lower end, whereby when a projectile passes through a target face mounted on said housing and strikes said interceptor element, said interceptor element flexes and moves freely to deflect the projectile downward without substantially deforming the projectile or piercing said interceptor element;

a roller mounting assembly on said housing disposed at a first side of said target mounting zone, said roller mounting assembly including means for mounting a roll of target faces on said housing;

means for securing a target face to said housing at an opposite second side of said target mounting zone from said first side;

said roller mounting assembly including a turning handle rotatably mounted on said housing;

a stop projecting from one of said housing and said turning handle, the other of said housing and said turning handle having stop surfaces thereon disposed to selectively contact said stop; and means for selectively shifting said stop surfaces out of contact with said stop.

11. The projectile capturing device of claim 10, wherein:

said roller mounting assembly includes a first and a second roll mounting element having means for supporting a roll of target faces therebetween, said first roll mounting element being mounted on said housing, and said second roll mounting element being slidably coupled to said turning handle to rotate therewith; and means for slidably biasing said roller handle away from said second roll mounting element and for biasing said stop surfaces into contact with said stop.

12. The projectile capturing device of claim 11, wherein:

said turning handle includes a mounting flange extending annularly about one end thereof, said stop surfaces disposed on said mounting flange, said turning handle being slidably and rotatably received in an aperture through said housing, and said mounting flange selectively abutting said housing.

13. The projectile capturing device of claim 12, wherein:

said securing means includes a plurality of target face receiving hooks located on said second side of said target mounting zone.

14. The projectile capturing device of claim 13, further comprising:

a continuous roll of target faces mounted on said roller mounting assembly.

15. A projectile capturing device comprising:

a housing defining a target mounting zone;

a roller mounting assembly on said housing disposed at a first side of said target mounting zone, said roller mounting assembly including means for mounting a roll of target faces on said housing, and means for selectively stopping a roll of target faces mounted thereon from unrolling;

means for securing a target face to said housing at an opposite second side of said target mounting zone from said first side, whereby said assembly provides for a roll of target faces to be mounted on said roller mounting assembly, a target face extended across said target mounting zone and secured to the housing on the side opposite said roller assembly;

said roller mounting assembly including a turning handle rotatably mounted on said housing;

said stopping means including a stop projecting from one of said housing and said turning handle, the other of said housing and said turning handle having stop surfaces thereon disposed to selectively contact said stop; and means for selectively shifting said stop surfaces out of contact with said stop.

16. The projectile capturing device of claim 15, wherein:

said roller mounting assembly includes a first and a second roll mounting element having means for supporting a roll of target faces therebetween, said first roll mounting element being mounted on said housing, and said second roll mounting element being slidably coupled to said turning handle to rotate therewith; and means for slidably biasing said turning handle away from said second roll mounting element and for biasing said stop surfaces into contact with said stop.

17. The projectile capturing device of claim 16, wherein:

said roller handle includes a cavity therein extending through a side of said handle, said cavity having keyways extending therealong; and said second roll mounting element being slidably received in said cavity and said second roll mounting element having keys thereon slidably received in said keyways.

18. The projectile capturing device of claim 17, wherein:

said turning handle includes a mounting flange extending radially about one end, said mounting flange having said stop surfaces thereon, said turning handle being slidably, rotatably received in an aperture through said housing, said mounting flange selectively abutting said housing.

19. The projectile capturing device of claim 18, further comprising:

a continuous roll of target faces mounted on said roller mounting assembly.

20. The projectile capturing device of claim 19, wherein:

said continuous roll of target faces includes a plurality of adjacent individual target faces, each said individual target face being separated from said adjacent target faces by a line of perforations therein.

21. The projectile capturing device of claim 20, wherein:

said securing means includes a plurality of target face receiving hooks located on said second side of said target mounting zone.

22. The projectile capturing device of claim 21, wherein:

said housing has a rearwardly, downwardly sloping rear wall; and three flexible interceptor elements mounted on said rear wall so as to depend freely therefrom, said flexible interceptor elements each having an unsecured lower end.

23. A projectile capturing device comprising:

a housing defining a target mounting zone;

a continuous roll of target faces mounted on said housing such that one of said target faces is positionable in said target mounting zone, said target faces being made from a polymeric material, and said target faces having a first color;

said housing including a rear surface located behind said target mounting zone, said rear surface having a second color contrasting to said first color;

whereby said target faces are provided with the ability to be pierced by a projectile and leave well defined apertures therethrough absent tears into said target faces away from said apertures and projectiles passing through said target leave apertures that are clearly visible due to the contrasting color of said rear surface;

means for pulling said one target face taut comprising, a roller mounting assembly on said housing located at the bottom of said target mounting zone, said roller mounting assembly including means for mounting a roll of target faces on said housing, means for securing a target face to said housing at the upper area of said target mounting zone, said roller mounting assembly including means for selectively stopping said roll of target faces from unrolling, whereby one can secure a target face at the upper area of said target mounting zone or turn said roller assembly to tauten said target face and engage said stopping means to hold said face taut;

said roller mounting assembly including a turning handle rotatably mounted on said housing;

said stopping means including a stop projecting from one of said housing and said turning handle, the other of said housing and said turning handle having stop surfaces thereon disposed to selectively contact said stop; and means for selectively shifting said stop surfaces out of contact with said stop.

24. The projectile capturing device of claim 23, wherein:

said roller mounting assembly includes a first and a second roll mounting element having means for supporting a roll of target faces therebetween, said first roll mounting element being mounted on said housing, and said second roll mounting element being slidably coupled to said turning handle to rotate therewith; and means for slidably biasing said turning handle away from said second roll mounting element and for biasing said stop surfaces into contact with said stop.

25. The projectile capturing device of claim 24, wherein:

said roller handle includes a cavity therein extending through a side of said handle, said cavity having keyways extending therealong; and said second roll mounting element being slidably received in said cavity and said second roll mounting element having keys thereon slidably received in said keyways.

26. The projectile capturing device of claim 25, wherein:

said turning handle includes a mounting flange extending radially about one end, said mounting flange having said stop surfaces thereon, said turning handle being slidably, rotatably received in an aperture through said housing, said mounting flange selectively abutting said housing.

* * * * *

UNITED STATES PATENT AND TRADEMARK OFFICE

CERTIFICATE OF CORRECTION

PATENT NO. : 4,583,744

DATED : April 22, 1986

INVENTOR(S) : Wilbur E. Tolliver and Larry R. Magnuson

It is certified that error appears in the above-identified patent and that said Letters Patent are hereby corrected as shown below:

Column 1, line 57:
"shotting" should be --shooting--;

Column 2, line 18:
"obsecuring" should be --obscuring--;

Column 4, line 20:
"tensil" should be --tensile--;

Column 5, line 26:
delete "the" (second occurrence);

Column 6, line 8:
"therefor" should be --therefore--;

Column 6, line 66:
"stabalizer" should be --stabilizer--;

Column 10, line 29, claim 8:
"betweeen" should be --between--.

Signed and Sealed this

*Second* Day of *September 1986*

[SEAL]

*Attest:*

DONALD J. QUIGG

*Attesting Officer*

*Commissioner of Patents and Trademarks*